US010155640B2

(12) United States Patent
Gewinner et al.

(10) Patent No.: US 10,155,640 B2
(45) Date of Patent: Dec. 18, 2018

(54) ELEVATOR SYSTEM USING RESCUE STORAGE DEVICE FOR INCREASED POWER

(71) Applicant: Otis Elevator Company, Farmington, CT (US)

(72) Inventors: Juergen Gewinner, Berlin (DE); Felix Benjamin Donath, Berlin (DE); Peter Herkel, Berlin (DE); Daryl J. Marvin, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 330 days.

(21) Appl. No.: 15/024,094

(22) PCT Filed: Sep. 24, 2013

(86) PCT No.: PCT/US2013/061348
§ 371 (c)(1),
(2) Date: Mar. 23, 2016

(87) PCT Pub. No.: WO2015/047219
PCT Pub. Date: Apr. 2, 2015

(65) Prior Publication Data

US 2016/0229666 A1 Aug. 11, 2016

(51) Int. Cl.
*B66B 1/08* (2006.01)
*B66B 5/02* (2006.01)
(Continued)

(52) U.S. Cl.
CPC ..... *B66B 5/027* (2013.01); *B66B 1/28* (2013.01); *B66B 1/302* (2013.01)

(58) Field of Classification Search
CPC ..... B66B 5/027; B66B 1/28; B66B 1/302
(Continued)

(56) References Cited

U.S. PATENT DOCUMENTS 6,439,348 B2 * 8/2002 Tajima ..... B66B 1/30 187/290
6,471,013 B2 10/2002 Banno et al.
(Continued)

FOREIGN PATENT DOCUMENTS

CN 1311150 A 9/2001
CN 101336201 A 12/2008
(Continued)

OTHER PUBLICATIONS

Chinese Second Office Action for application CN 201380079803.4, dated Oct. 20, 2017, 10 pages.
(Continued)

*Primary Examiner* — Anthony Salata
(74) *Attorney, Agent, or Firm* — Cantor Colburn LLP

(57) ABSTRACT

An elevator system includes a primary source of electrical power; a power unit having a power supply, the power supply producing DC power from the primary source of electrical power. A rescue storage device provides power to the elevator system when the primary source of electrical power is unavailable. The rescue storage device is coupled to an output of the power supply to provide additional DC power with the DC power when the primary source of electrical power is available and an increased power requirement is present.

15 Claims, 4 Drawing Sheets

(51) Int. Cl.
*B66B 1/28* (2006.01)
*B66B 1/30* (2006.01)

(58) Field of Classification Search
USPC ..... 187/247, 277, 288, 290, 293, 296, 297, 187/391, 393; 318/362, 375, 376, 318/801–815
See application file for complete search history.

(56) References Cited

U.S. PATENT DOCUMENTS

| | | | | |
|---|---|---|---|---|
| 6,522,099 | B2 | 2/2003 | Tominaga et al. | |
| 6,732,838 | B1 | 5/2004 | Okada et al. | |
| 6,827,182 | B2 * | 12/2004 | Araki | B66B 5/027 187/290 |
| 7,554,278 | B2 * | 6/2009 | Wegner-Donnelly | B66C 13/18 187/277 |
| 8,146,714 | B2 * | 4/2012 | Blasko | B66B 1/30 187/290 |
| 8,172,042 | B2 | 5/2012 | Wesson et al. | |
| 8,220,590 | B2 * | 7/2012 | Chen | B66B 1/302 187/290 |
| 8,230,978 | B2 * | 7/2012 | Agirman | B66B 5/027 187/290 |
| 8,616,338 | B2 * | 12/2013 | Veronesi | B66B 1/302 187/290 |
| 8,887,872 | B2 * | 11/2014 | Chen | G01R 31/3651 187/290 |
| 9,440,819 | B2 * | 9/2016 | Rossignol | B66B 1/302 |
| 9,533,858 | B2 * | 1/2017 | Hanninen | B66B 1/34 |
| 9,834,406 | B2 * | 12/2017 | Mezzadri | B66B 1/306 |
| 9,914,617 | B2 * | 3/2018 | Horbrugger | B66B 1/302 |
| 2001/0017239 | A1 | 8/2001 | Tajima | |
| 2005/0224296 | A1 | 10/2005 | Smith et al. | |
| 2009/0014252 | A1 | 1/2009 | Vedula et al. | |
| 2016/0083220 | A1 * | 3/2016 | Agirman | H02J 7/02 187/290 |

FOREIGN PATENT DOCUMENTS

| | | | |
|---|---|---|---|
| CN | 102143902 | A | 8/2011 |
| EP | 1268335 | A1 | 1/2003 |
| JP | S61267675 | A | 11/1986 |
| JP | 2002154759 | A | 5/2002 |
| JP | 2005015067 | A | 1/2005 |
| JP | 2005104608 | A | 4/2005 |
| WO | 2009085288 | A2 | 7/2009 |

OTHER PUBLICATIONS

First Chinese Office Action and Search report for application CN 201380079803.4, dated Mar. 15, 2017, 13pgs.
International Search Report for application PCT/US2013/061348, dated Jun. 12, 2014, 6 pages.
Written Opinion for application PCT/US2013/061348, dated Jun. 12, 2014, 8 pages.
European Search Report for application EP 13894228.9, dated Apr. 24, 2017, 7pgs.

* cited by examiner

ELEVATOR SYSTEM USING RESCUE STORAGE DEVICE FOR INCREASED POWER

FIELD OF INVENTION

The subject matter disclosed herein relates generally to the field of elevator systems, and more particularly, to an elevator system that uses the rescue storage device to provide power during increased power demands.

BACKGROUND

The power requirement of an elevator system changes with the operational status of the elevator system. For example, the elevator system may have different power requirements depending on whether the elevator car is idle, the elevator car is running, the elevator door is cycling, etc. Certain operations cause a peak or increase in the power requirement of the elevator system, such and lifting the brake with a pick current and opening the elevator car door. In both cases the time the increased power is needed is about 2 seconds. The increased power requirement may exceed 150% of the power needed while the elevator is running Existing power supplies are designed to cover the peak requirements, which is not cost effective and not space effective.

SUMMARY

According to an exemplary embodiment, an elevator system includes a primary source of electrical power; a power unit having a power supply, the power supply producing DC power from the primary source of electrical power; and a rescue storage device providing power to the elevator system when the primary source of electrical power is unavailable; the rescue storage device coupled to an output of the power supply to provide additional DC power with the DC power when the primary source of electrical power is available and an increased power requirement is present.

Other aspects, features, and techniques of embodiments of the invention will become more apparent from the following description taken in conjunction with the drawings.

BRIEF DESCRIPTION OF THE DRAWINGS

Referring now to the drawings wherein like elements are numbered alike in the FIGURES.

DETAILED DESCRIPTION

Figure 1:
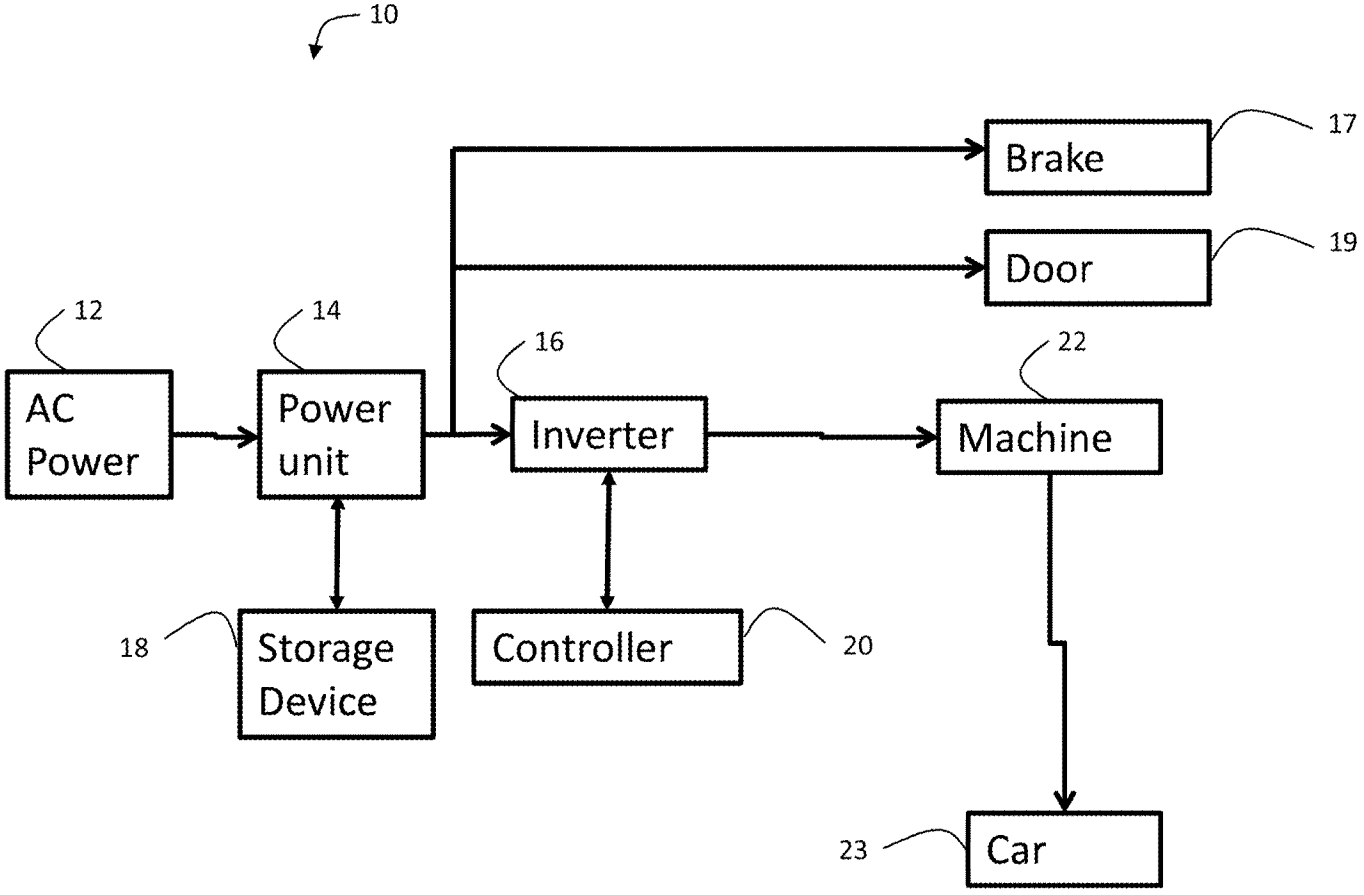
FIG. 1 is a block diagram of components of an elevator system in an exemplary embodiment.

FIG. 1 is a block diagram of components of an elevator system 10 in an exemplary embodiment. Elevator system 10 includes a primary source of power 12, such as AC power from an electrical main line (e.g., 230 volt, single phase). The AC power 12 is provided to a power unit 14, which converts the AC power to DC power. The DC power output from power unit 14 is provided to an inverter 16, which converts DC power from power unit 14 to AC drive signals, which drive machine 22 to impart motion to elevator car 23. The AC drive signals may be multiphase (e.g., three-phase) drive signals for a three-phase motor in machine 22. A controller 20 is coupled to the inverter 16 to control inverter 16 over various operational modes. The power unit 14 also provides DC power to elevator brake 17 and elevator door 19. It is understood that other components of elevator system 10 may be powered from power unit 14.

A rescue storage device 18 (e.g., 12 VDC battery, capacitor bank, etc.) is connected to the power unit 14. Rescue storage device 18 is used to provide DC power to the inverter 16, elevator brake 17 and elevator door 19 in the event that the AC power 12 becomes unavailable (e.g., brown out). When AC power 12 becomes unavailable, rescue storage device 18 provides power to the elevator system to direct the elevator car 23 to the nearest floor and open the elevator car door. Rescue storage device 18 is also used to provide additional DC power that is added to the DC output of power unit 14 when AC power 12 is available and an increased power requirement is present. Rescue storage device 18 may be a lead-acid battery, lithium-ion battery, capacitor bank, or other type of energy storage device.

Figure 2:
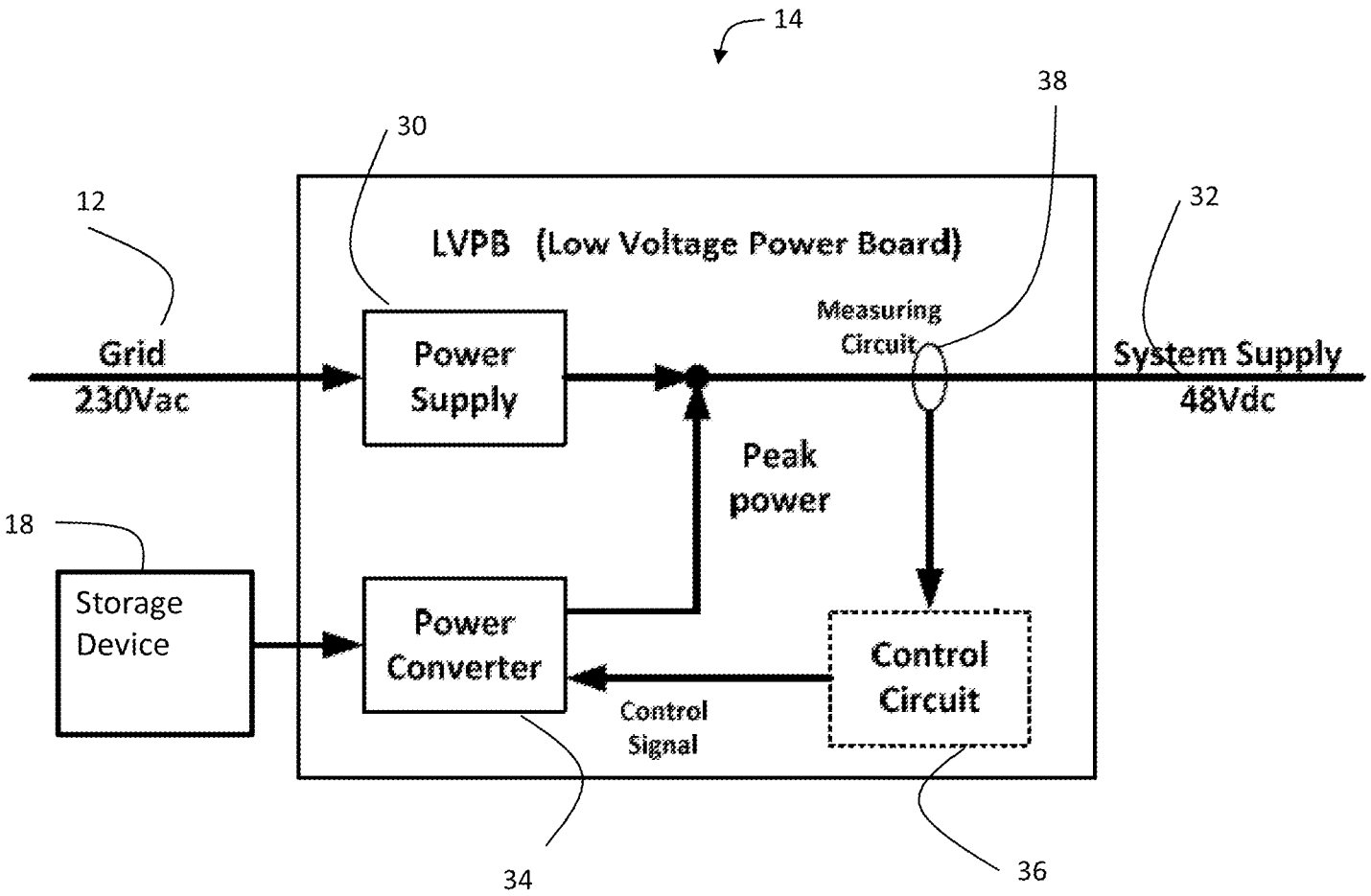
FIG. 2 depicts components of a power unit in an exemplary embodiment.

FIG. 2 depicts power unit 14 in an exemplary embodiment. As shown in FIG. 2, power unit 14 receives AC power 12 from a primary power source, for example, the electrical grid (e.g., 230 VAC). A power supply 30 converts the AC power 12 to DC power 32 (e.g., 48 volts DC). Power supply 30 may include rectifier(s), voltage regulator(s), etc. to perform the AC-DC conversion. DC power 32 from power supply 30 is provided to inverter 16, brake 17 and door 19 as shown in FIG. 1.

A power converter 34 is connected to the DC output of power supply 30. Power converter 34 is also connected to rescue storage device 18. Power converter 34 provides bi-directional current flow between the output of power supply 30 and rescue storage device 18. A control circuit 36 monitors the output of power supply 30 through one or more sensors 38. Control circuit 36 may be implemented using a microprocessor, logic gates, etc. Sensor 38 may detect voltage and/or current at the output of power supply 30. In response to a sensor signal from sensor 38, control circuit 36 detects when an increased power requirement for the elevator system is present. Control circuit 36 generates a control signal to power converter 34 to control the mode of operation of power converter 34. If no increased power requirement is detected, then power converter 34 operates in a charging mode to charge rescue storage device 18 using the output of power supply 30. In the charging mode, power converter 34 converts the output voltage of power supply 30 (e.g., 48 VDC) to a voltage suitable to charge rescue storage device 18 (e.g., 12-14 VDC). If an increased power requirement is detected, then power converter 34 operates in a supply mode to convert DC power from rescue storage device 18 (e.g., 12 VDC) to a level compatible with the output of power supply 30 (e.g., 48 VDC) so that additional DC power from rescue storage device 18 is added to the DC output of power supply 30.

Control circuit 36 may also monitor a status of rescue storage device 18 using known techniques, such as storage device state of charge and/or storage device state of health analysis. Should the rescue storage device 18 status drop below a threshold, control circuit 36 can prevent use of rescue storage device 18 in the supply mode until the storage device status is above the threshold. This preserves rescue storage device 18 for rescue functions in the event the primary power source 12 is unavailable. One or more operational parameters of the elevator system may be altered (e.g., car speed reduced) until the rescue storage device 18 status is above the threshold. Control circuit 36 may communicate with controller 20 to initiate adjusting the operational parameter(s) of the system in response to the status of rescue storage device 18.

Figure 3:
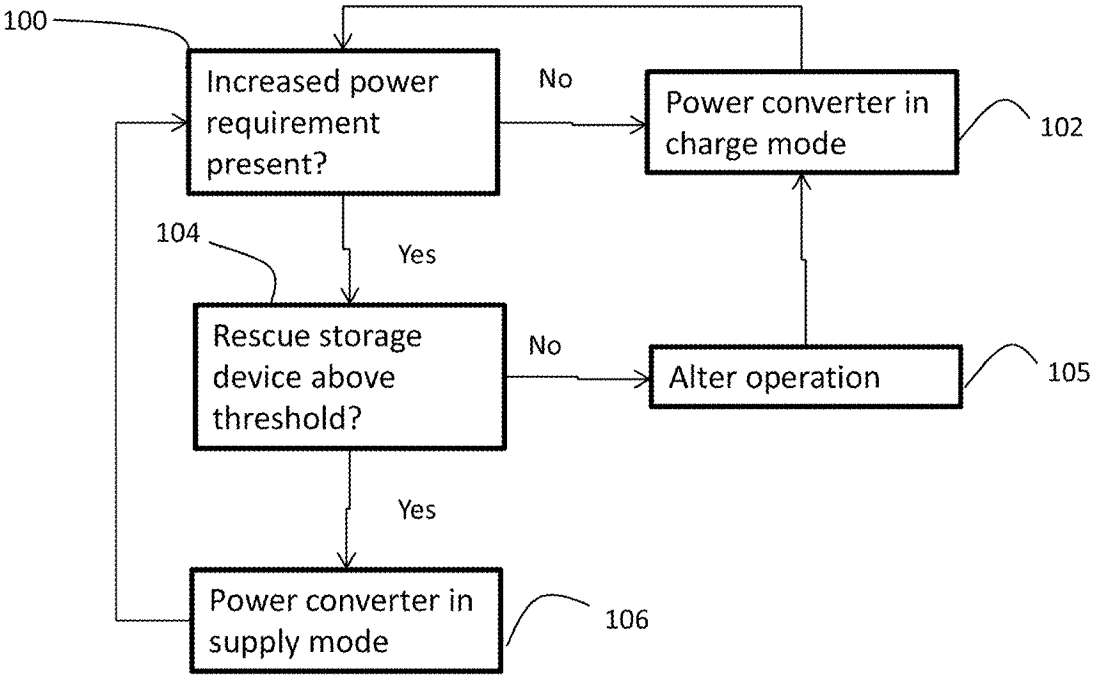
FIG. 3 is a flowchart of operation of the power unit in an exemplary embodiment.

FIG. 3 is a flowchart of operation of the elevator system under normal operating conditions (i.e., when primary power source 12 is available). The system operates such that during increased power requirements (e.g., lifting brake 17 or opening door 19) additional DC power is drawn from rescue storage device 18 and added to the DC output of the power supply 30. The process begins at 100 where control circuit 36 monitors the output of power supply 30 to determine if an increased power requirement is detected. As noted above, the control circuit 36 may monitor voltage and/or current on the output of power supply 30 to detect an increased power requirement. An increased power requirement may be detected when the voltage at the output of power supply 30 drops below a lower voltage limit. An increased power requirement may also be detected when the current at the output of power supply 30 rises above an upper current limit. An increased power requirement may be detected when both the voltage is below a lower voltage limit and the current is above an upper current limit If no increased power requirement is detected, flow proceeds to 102, where control circuit 36 issues a control signal to power converter 34 to place power converter 34 in charge mode. In charge mode, rescue storage device 18 is charged from the DC output of power supply 30. From 102, flow proceeds to 100.

If at 100 an increased power requirement is detected, flow proceeds to 104, where control circuit 36 determines if the rescue storage device status is above a threshold. This may be performed by monitoring voltage at rescue storage device 18 or using more complex techniques, such as state of health and/or state of charge analysis. If the rescue storage device status is not sufficient, then flow proceeds to 105 where one or more operational parameters (e.g., car speed, car acceleration/deceleration) is altered to reduce power consumption of the system. From 105, flow proceeds to 102 where power converter 34 is placed in charge mode.

If at 104 the rescue storage device status is above the threshold, flow proceeds to 106 where control circuit 36 issues a control signal to power converter 34 to place power converter 34 in supply mode. In supply mode, power converter 34 converts the DC voltage from rescue storage device 18 (e.g., 12 volts) to a level compatible with the output of the power supply 30 (e.g., 48 volts). Additional DC power from rescue storage device 18 is then added to the positive DC output of power supply 30 to accommodate the increased power requirement. From 106, flow proceeds to 100.

Figure 4:
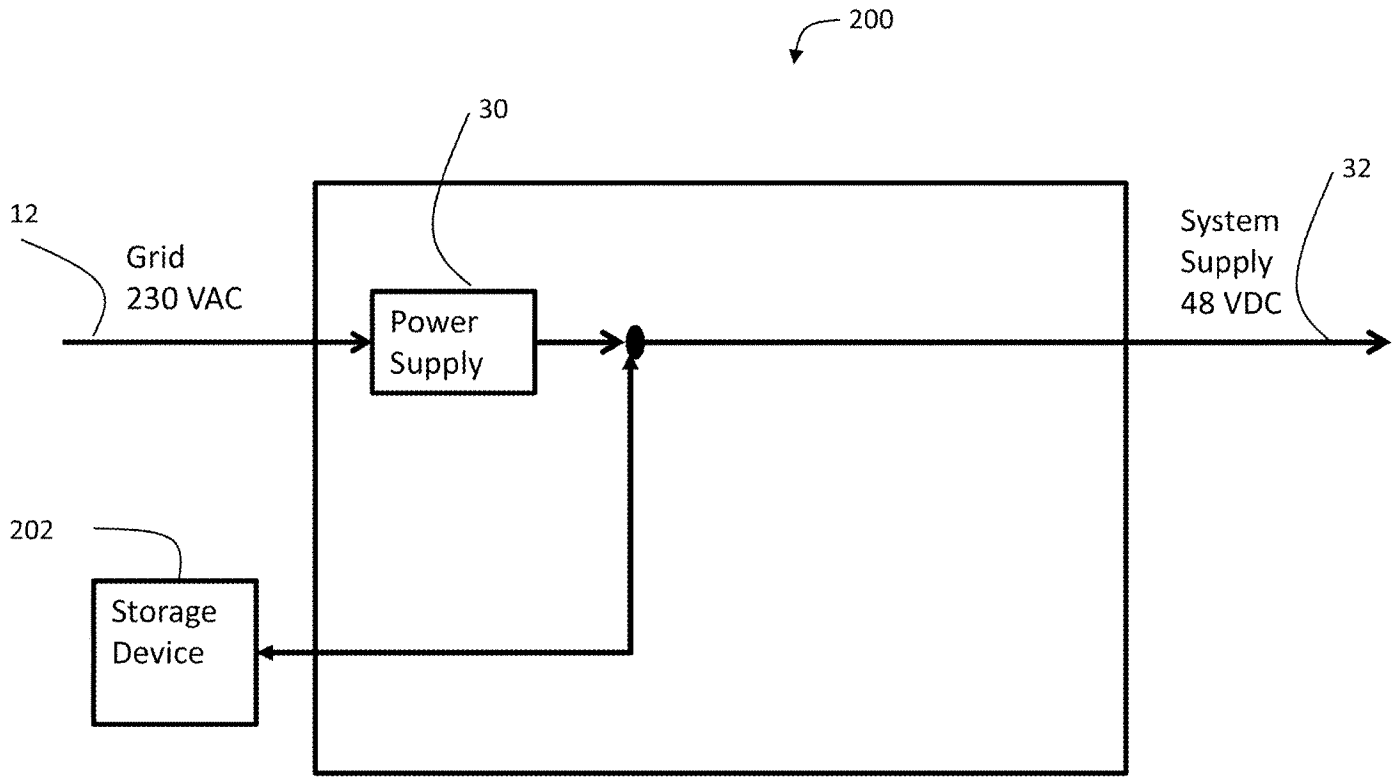
FIG. 4 depicts components of a power unit in an exemplary embodiment.

FIG. 4 depicts components of a power unit 200 in another exemplary embodiment. In the embodiment of FIG. 4, power unit 200 receives a primary source of power 12 (e.g., 230 VAC from the grid) and power supply 30 converts the AC power 12 to DC power 32 (e.g., 48-50 VDC) to serve as system supply voltage. Rescue storage device 202 has a voltage (e.g., 48 VDC) less than the output voltage of power supply 30. The positive terminal of rescue storage device 202 is connected to the output of power supply 30.

In operation, when an increased power requirement is not present, rescue storage device 202 is charged by the output of power supply 30, until the voltage at rescue storage device 202 is substantially equal to the DC output of power supply 30. When an increased power requirement is present, additional DC power is drawn from rescue storage device 202 by the increased load on the power unit 200 and added to the DC output of power supply 30. When the increased power requirement ceases, rescue storage device 202 is again charged by the output of power supply 30.

In exemplary embodiments, the period of the increased power requirement is greater than the recharge time of the rescue storage device such that the rescue storage device can be recharged in between times of increased power requirement. For example, in one exemplary installation, the increased power requirement may be present once every 30 seconds and the rescue storage device can be recharged in 12 seconds. The power unit 14 is sized such that it provides suitable power to machine 22 during normal operating modes (e.g., when and increased power requirement is not present) and sized such that rescue storage devices 18 can be recharged in between periods of increased power requirement.

Embodiments provide a number of advantages over existing designs. As the power unit uses the rescue storage device to supply power during periods of increased power requirement, the power supply can be designed to a lower power requirement. The results in a lower cost power supply and a more compact power supply. The existing power converter and rescue storage device are used during normal operation (e.g., when the primary power source is available). Heat losses are also distributed across the power unit, avoiding localized heat buildup or hot spots.

The terminology used herein is for the purpose of describing particular embodiments only and is not intended to be limiting of the invention. While the description of the present invention has been presented for purposes of illustration and description, it is not intended to be exhaustive or limited to the invention in the form disclosed. Many modifications, variations, alterations, substitutions, or equivalent arrangement not hereto described will be apparent to those of ordinary skill in the art without departing from the scope and spirit of the invention. Additionally, while the various embodiments of the invention have been described, it is to be understood that aspects of the invention may include only some of the described embodiments and that various aspects of the invention, although described in conjunction with one exemplary embodiment may be used or adapted for use with other embodiments even if not expressly stated. Accordingly, the invention is not to be seen as being limited by the foregoing description, but is only limited by the scope of the appended claims.

The invention claimed is:

1. An elevator system comprising:

a primary source of electrical power;

a power unit having a power supply, the power supply producing DC power from the primary source of electrical power; and a rescue storage device providing power to the elevator system when the primary source of electrical power is unavailable;

the rescue storage device coupled to an output of the power supply to provide additional DC power with the DC power when the primary source of electrical power is available and an increased power requirement is present.

2. The elevator system of claim 1 further comprising:

a power converter coupling the rescue storage device to the output of the power supply; and a control circuit providing a control signal to the power converter, the control signal controlling an operational mode of the power converter.

3. The elevator system of claim 2 wherein:

the power converter operates in charging mode to charge the rescue storage device when the primary source of electrical power is available and the increased power requirement is not present.

4. The elevator system of claim 2 wherein:

the power converter operates in supply mode to provide the additional DC power when the primary source of electrical power is available an increased power requirement is present.

5. The elevator system of claim 4 wherein:

the control circuit determines a storage device status of the rescue storage device.

6. The elevator system of claim 5 wherein:

the control circuit inhibits operation in supply mode when the storage device status is below a threshold.

7. The elevator system of claim 5 wherein:

the storage device status is determined in response to state of charge or state of health of the rescue storage device.

8. The elevator system of claim 5 wherein:

the control circuit initiates adjusting an operational parameter of the elevator system when the storage device status is below a threshold.

9. The elevator system of claim 8 wherein:

the operational parameter of the elevator system is at least one of elevator car speed and elevator car acceleration/deceleration.

10. The elevator system of claim 2 further comprising:

a sensor for detecting a condition at the output of the power supply and providing a sensor signal to the control circuit.

11. The elevator system of claim 10 wherein:

the sensed condition is voltage, the control circuit determining that the increased power requirement is present in response to the voltage being below a lower voltage limit.

12. The elevator system of claim 10 wherein:

the sensed condition is current, the control circuit determining that the increased power requirement is present in response to the current being above an upper current limit.

13. The elevator system of claim 10 wherein:

the sensed condition includes voltage and current, the control circuit determining that the increased power requirement is present in response to the voltage being below a lower voltage limit and the current being above an upper current limit.

14. The elevator system of claim 1 wherein:

the primary source of electrical power is AC.

15. The elevator system of claim 1 wherein:

the rescue storage device is a battery.

* * * * *